US005551924A

United States Patent [19]

Zumtobel

[11] Patent Number: 5,551,924

[45] Date of Patent: Sep. 3, 1996

[54] PUTTING TRAINING APPARATUS

[75] Inventor: Daniel C. Zumtobel, Las Vegas, Nev.

[73] Assignee: Muscle Memory Sports, Las Vegas, Nev.

[21] Appl. No.: 517,362

[22] Filed: Aug. 21, 1995

[51] Int. Cl.[6] ..... A63B 69/36

[52] U.S. Cl. ..... 473/238; 473/250; 473/253

[58] Field of Search ..... 273/186.2; 473/238, 473/250, 253

[56] References Cited

U.S. PATENT DOCUMENTS

| | | | |
|---|---|---|---|
| 3,495,834 | 2/1970 | Tanczos | 273/163 |
| 3,649,028 | 3/1972 | Worrell | 273/186.2 X |
| 4,174,838 | 11/1979 | Paschetto | 273/77 R |
| 4,544,160 | 10/1985 | Miner | 273/186 C |
| 4,700,949 | 10/1987 | Nottoli | 273/192 |
| 4,789,158 | 12/1988 | Chiesa | 273/163 A |
| 4,949,971 | 8/1990 | Thornton | 273/186 A |
| 5,143,376 | 9/1992 | Johnson | 273/186.2 |
| 5,332,211 | 7/1994 | Rife et al. | 273/187.6 |
| 5,351,961 | 10/1994 | Eaulau | 273/164.1 |
| 5,351,962 | 10/1994 | Lin | 273/186.2 |

*Primary Examiner*—George J. Marlo
*Attorney, Agent, or Firm*—Meschkow & Gresham

[57] ABSTRACT

A training apparatus that indicates the alignment of a practice golf stroke includes a base plate and a club member. The base plate includes a body, a pointer, a guide strip, and a warning background. The club member attaches to a golf club, and includes a mounting clip, an extension arm, and a colored translucent blade coupled together. The guide strip, warning background, and blade cooperate to indicate a first color when the practice stroke is aligned and a second color when the practice stroke is misaligned. The apparatus is configured such that a golf ball travels over the practice surface during use, and such that a user can clearly view the golf ball in the address position and as it is struck by the golf club.

17 Claims, 2 Drawing Sheets

PUTTING TRAINING APPARATUS

FIELD OF THE INVENTION

The present invention relates generally to golf equipment. More specifically, the present invention relates to a training device that indicates when a proper golf stroke is performed.

BACKGROUND OF THE INVENTION

Golf and golfing equipment have existed for hundreds of years. Over time, different types of practice and training aids have been developed to assist golfers in their quest for a lower handicap. Putting is one aspect of the game that requires precision and skillful muscle control. Because a proper putting stroke can be critical to golfing success, various devices are marketed and sold to golfers who are seeking to improve their putting proficiency.

One known putting trainer may be characterized as a T-shaped putter attachment. This device is designed to point along a line parallel to the desired target line. Although useful for its intended purpose, this device does not help the golfer properly align his or her putter relative to a target or target line before or during the putting stroke. In addition, putting trainers utilizing this basic concept typically obstruct the user's view of the golf ball, the putting surface, and/or the putter head. A clear view is important because a golfer typically focuses on the golf ball before and during the putting stroke, and any obstructions may be distracting to the golfer.

Other putting training devices may interfere with either the golf ball, the putter head, or the putting surface. Such devices may cause the golf ball to roll over unnatural surfaces or force the golfer to perform an unusual putting stroke. Such devices are undesirable because they fail to replicate actual putting conditions. For example, one known putting device is configured such that the golf ball must remain on a base plate during the putt. The thickness of the base plate inherently raises the golf ball above the putting surface and the surface of the base plate affects the outcome of the putt. Unfortunately, practicing on an unnatural surface does not allow the user to develop the skill and muscle memory required when putting on varying surfaces. Thus, a golfer trained by such a device may putt inconsistently depending upon the speed, break, or grain growth of the green.

For best results, a golfer should keep his or her head relatively stationary during a putting or other golf stroke. Unfortunately, many known putting devices require the golfer to lift his or her head to verify the alignment of the putter and/or the target line. These devices may do more harm than good because a user may develop improper putting techniques during practice sessions.

Several conventional putting trainers utilize some form of measuring apparatus to analyze the mechanics or geometry of the putting stroke. These trainers typically require the reading of various measurements or the interpretation of data. While such devices may be adequate for precise scientific analyses, they may not provide real-time feedback to the golfer during the putting stroke. In addition, these devices may not allow a golfer to quickly and easily repeat the practice stroke, which is important for developing muscle memory.

SUMMARY OF THE INVENTION

Accordingly, it is an advantage of the present invention that an improved putting training device is provided.

Another advantage of the present invention is that the putting training device indicates an initial putting direction and indicates whether the putter is properly aligned, relative to the putting direction, during the putting stroke.

Another advantage is that the putting training device does not obstruct the user's view of the golf ball or the putter head during use.

A further advantage is that the putting training device does not interfere with the natural position of the golf ball on the putting surface.

Another advantage is that the present invention provides a putting training device that allows practice putts to roll on a natural surface.

Another advantage is that the putting training device allows the user to maintain his or her head in a stationary position during the stroke.

An additional advantage of the present invention is that the putting training device provides real-time feedback to the user that is easy to interpret.

The above and other advantages of the present invention are carried out in one form by a training apparatus having a base plate and a club member. The base plate includes a body, a pointer for directionally adjusting the base plate relative to a target, and means for indicating the alignment of a golf club relative to a target line. The club member includes means for mounting the club member onto the golf club, an extension arm coupled to the means for mounting, and a blade attached to the extension arm. The blade cooperates with the means for indicating to indicate the alignment of the golf club.

BRIEF DESCRIPTION OF THE FIGURES

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENT

Figure 1:
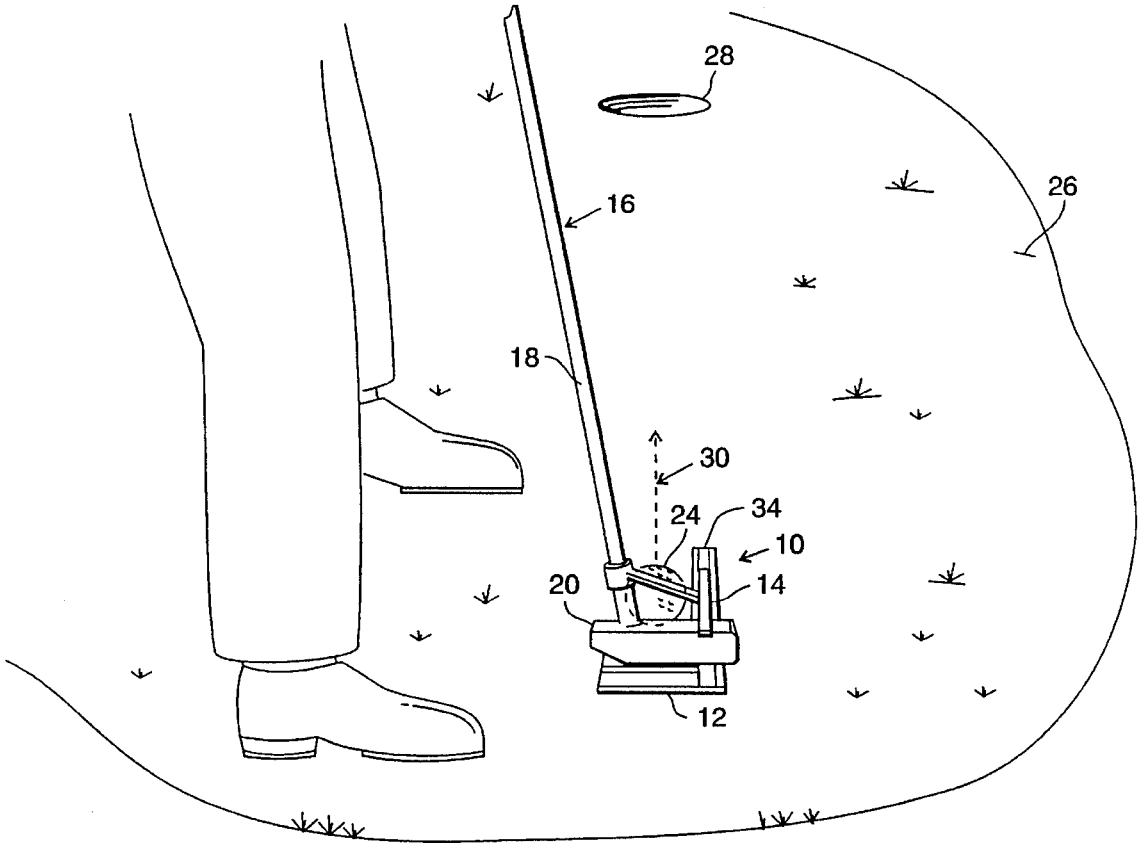
FIG. 1 shows an exemplary environment for a golf stroke training apparatus according to the present invention.

Referring to FIG. 1, a golf stroke training apparatus 10 according to the preferred embodiment of the present invention is illustrated in a typical training environment. For the sake of clarity and brevity, apparatus 10 is described herein in connection with putting training. However, apparatus 10 may alternatively be utilized with other golf clubs, such as pitching wedges, to develop a chipping stroke. Thus, although specific reference is made to putters and putting strokes, the present invention is not limited to putting applications.

Apparatus 10 generally includes a base plate 12 and a putter member 14. Apparatus 10 is preferably utilized in conjunction with a putter 16, which includes a shaft 18, a putter head 20 attached to shaft 18, and a putter face 22 (see FIGS. 3–4) defined by putter head 20. Putter face 22 is hidden from view in FIG. 1. During putting practice, apparatus 10 is preferably used with a golf ball 24, which travels upon a putting surface 26 toward a target 28. Putting surface 26 may be a natural grass surface or any other suitable practice surface. A user performs a putting stroke to cause putter head 20 to strike golf ball 24.

Prior to a practice stroke, the user preferably locates an initial target line 30, over which the user wishes golf ball 24 to travel immediately following contact with putter head 20. Initial target line 30 is an imaginary line that the user visualizes before putting. Thus, the user locates initial target line 30 by mentally choosing a desired path for golf ball 24. Also prior to the practice stroke, the user preferably adjusts the direction of base plate 12 relative to target 28. Base plate 12 may be directionally adjusted by aiming a pointer 34 (described below) toward target 28. By locating initial target line 30 and directionally adjusting base plate 12, the user attempts to control the directional component of the putt.

Those skilled at putting mechanics will recognize that target 28 may be a practice cup if putting surface 26 is substantially planar. However, if putting surface 26 is sloped, then target 28 may instead be an imaginary mark that compensates for the eventual curving of golf ball 24. If apparatus 10 is used to practice chipping strokes, then target 28 may be a desired area where the user wishes golf ball 24 to land. Alternatively, nothing prevents the present invention from being utilized without golf ball 24 or target 28.

Figure 2:
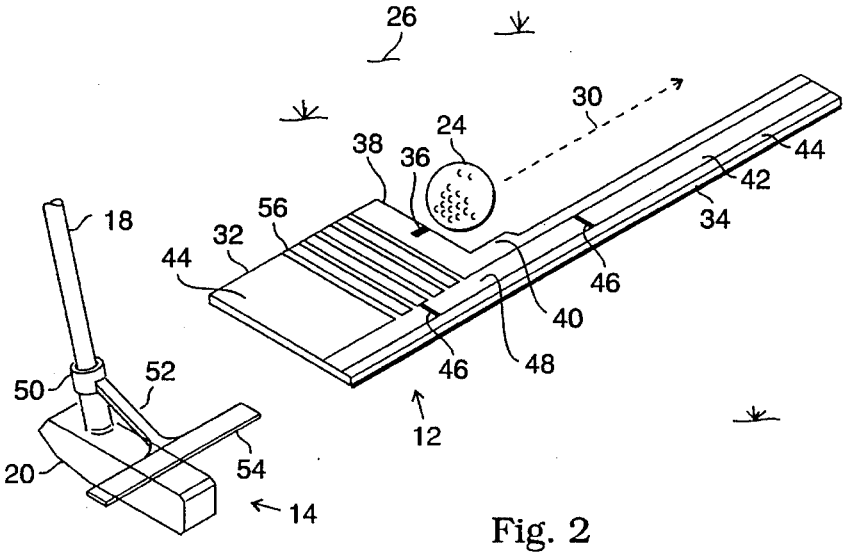
FIG. 2 is a perspective view of the training apparatus.

Referring to FIG. 2, apparatus 10 is illustrated in detail. Base plate 12 is adapted to be located upon putting surface 26. Because golf ball 24 initially rests on putting surface 26, base plate 12 is preferably thin enough such that the putting stroke need not be altered and such that putter head 20 contacts golf ball 24 at a natural height. According to the preferred embodiment, base plate 12 is approximately 0.10 inches thick. Base plate 12 may include a number of pins or spikes (not shown) mounted to its lower surface. The pins or spikes help to maintain the position of base plate 12 upon putting surface 26.

Base plate 12 preferably includes a body 32 and pointer 34 integral to body 32. Pointer 34 is preferably an elongated element extending from body 32 that may be utilized as a guide for directionally adjusting base plate 12 relative to target 28, as described above. According to the preferred embodiment, base plate 12 is configured such that it substantially does not interfere with the initial position of golf ball 24 upon putting surface 26. In other words, at the address position before the putting stroke, golf ball 24 rests predominantly on putting surface 26 rather than on base plate 12. In addition, base plate 12 preferably does not interfere with the travel of golf ball 24 after the user performs a putting stroke, i.e., golf ball 24 eventually travels over putting surface 26. This configuration allows the user to practice on a natural surface, such as a practice green, to develop his or her skill at reading variations in the green.

When using apparatus 10 in conjunction with golf ball 24, the user places golf ball 24 in an initial position upon putting surface 26. An exemplary initial position is shown in FIG. 2. The initial position is proximate base plate 12, and is preferably indicated by a positioning marker 36 located on a front edge 38 of body 32. In the initial position, golf ball 24 may, but need not, contact front edge 38. The specific location of positioning marker 36 along front edge 38 is chosen to approximately align with the sweet spot of putter head 20 when putter member 14 is aligned with base plate 12 (described below). Those skilled in this art will appreciate that putter head 20 should contact golf ball 24 near the sweet spot for best results. The sweet spot location is dependent upon the specific putter, thus the location of positioning marker 36 may vary accordingly. To accommodate this variability, positioning marker 36 may be formed from an adhesive material that can be removed and replaced by the user. Alternatively, one of a plurality of notches (not shown) formed within body 32 may be filled with ink or paint to form positioning marker 36.

Base plate 12 may also include a tab 40, which may be integral to pointer 34. Tab 40 is preferably a small amount of material located where front edge 38 meets pointer 34. The length of tab 40 along pointer 34 is chosen such that, if golf ball 24 contacts tab 40, golf ball 24 will not be directed by tab 40. The configuration of tab 40 urges golf ball 24 to avoid contacting pointer 34 following the putting stroke. Tab 40 also prevents golf ball 24 from being initially placed too close to pointer 34. Thus, tab 40 substantially prevents golf ball 24 from being guided by pointer 34 as it travels toward target 28.

According to the preferred embodiment, base plate 12 includes a guide strip 42 located on pointer 34 and a warning background 44 that substantially surrounds guide strip 42. Guide strip 42 and warning background 44 cooperate with putter member 14 to provide a color-based indication of the alignment of putter face 22 relative to initial target line 30 (described below). Warning background 44 preferably also covers a substantial area of body 32.

Guide strip 42 may also include a plurality of zone markers 46 that are spaced apart such that a contact zone 48 resides between zone markers 46. Contact zone 48 may be characterized as the approximate area where putter head 20 contacts golf ball 24 during the putting stroke. Those skilled in the art will appreciate that putter head 20 should be square to initial target line 30 while putter member 14 passes through contact zone 48. Thus, zone markers 46 indicate where the alignment of putter face 22 is most critical. Zone markers 46 may therefore be desirable to those golfers who putt with an open-square-closed stroke, or an inside-outside-inside stroke, rather than a straight stroke.

FIG. 2 also shows putter member 14 attached to shaft 18 of putter 16. Putter member 14 generally includes a mounting clip 50, an extension arm 52, and a blade 54. Mounting clip 50 is preferably formed from a resilient material that allows mounting clip 50 to adjustably mount putter member 14 onto shaft 18. Mounting clip 50 may be press-fit into place on shaft 18, and rotated to facilitate alignment of putter member 14. Following adjustment, the resilience and adhesion of mounting clip 50 maintain putter member 14 in a substantially fixed position on shaft 18.

Extension arm 52 is coupled to mounting clip 50, and blade 54 is attached Lo extension arm 52. According to the preferred embodiment, blade 54 and extension arm 52 are integrally formed from a lightweight material. The distance between mounting clip 50 and blade 54 may be selected according to the specific application. Such versatility allows apparatus 10 to be compatible with different types of putters.

According to the preferred embodiment, extension arm 52 is formed from a substantially transparent material such as clear plastic. Extension arm 52 displaces blade 54 from shaft 18 such that putter member 14 is T-shaped. The transparency of extension arm 52 and the displacement of blade 54 allow the user to view golf ball 24, putter head 20, and the area of putting surface 26 proximate golf ball 24. An unobstructed view of golf ball 24 in the initial position simulates actual putting conditions and is less distracting to the golfer. In addition, the configuration of base plate 12 and putter member 14 enables the user to practice the putting stroke while keeping his or her head substantially stationary. This configuration allows the user to examine the alignment of putter head 20 without lifting his or her head.

Figure 3:
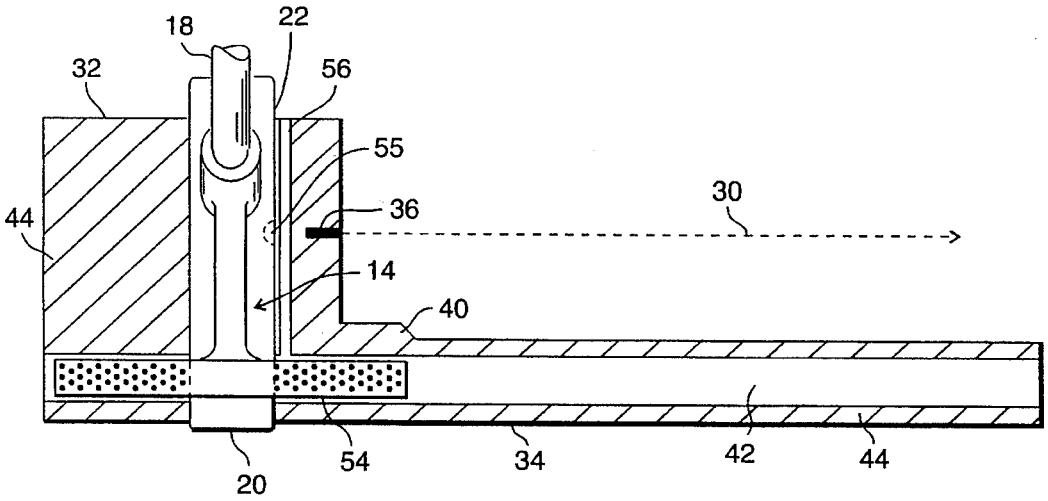
FIG. 3 is a top view of the training apparatus indicating an aligned putter head.
Figure 4:
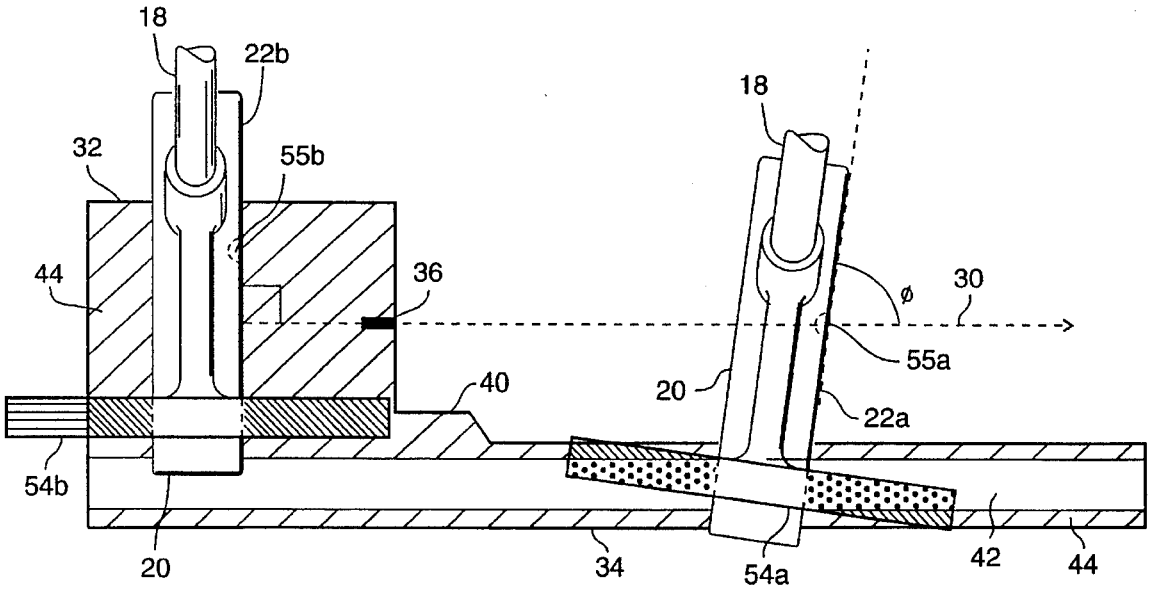
FIG. 4 is a top view of the training apparatus indicating examples of misaligned putter heads.

With reference now to FIGS. 3–4, a color indication feature of apparatus 10 will be described in detail. Some elements of apparatus 10 have been omitted from FIGS. 3–4 for the sake of clarity. According to a preferred aspect of the present invention, guide strip 42, warning background 44, and blade 54 cooperate to indicate an aligned putting stroke with a first color and a misaligned putting stroke with a second color, as perceived by the user. Apparatus 10 is preferably configured to indicate the translational alignment of putter head 20, and the perpendicular alignment of putter face 22, relative to initial target line 30. For purposes of this description, putter head 20 is translationally aligned if a sweet spot 55 is aligned with initial target line 30. For illustrative purposes, FIGS. 3–4 depict sweet spot 55 at a location approximately where shaft 18 attaches to putter head 20. This location is shown merely for the sake of convenience and clarity.

In the preferred embodiment, guide strip 42 is yellow, warning background 44 is red, and blade 54 is formed from a translucent blue material. Blade 54 is preferably formed from a clear plastic material, and colored by applying a thin blue acetate film onto the plastic. Due to the translucency of blade 54, the first color (green) is indicated when blade 54 overlaps guide strip 42, relative to the user. The green color results from the combination of blue (blade 54) and yellow (guide strip 42). The second color (purple) is indicated when blade 54 overlaps warning background 44, relative to the user. The purple color results from the combination of blue (blade 54) and red (warning background 44). The various colors are represented by different shading throughout the Figures. Of course, many different color schemes and combinations may be utilized, and the present invention is not limited to the preferred colors described herein.

FIG. 3 depicts blade 54 and the corresponding color indication for a properly aligned putting stroke. FIG. 4 depicts a blade 54*a* and the corresponding color indication for a perpendicularly misaligned putting stroke. As shown, putter face 22*a* forms an oblique angle $\phi$, rather than a right angle, with initial target line 30. Although sweet spot 55*a* is aligned with initial target line 30, blade 54*a* indicates an improper putting stroke. FIG. 4 also depicts a blade 54*b* and the corresponding color indication for a translationally misaligned putting stroke. Although putter face 22*b* is perpendicular to initial target line 30, sweet spot 55*b* is translationally offset from initial target line 30. Thus, even if putter face 22 is perpendicularly aligned, purple is indicated if sweet spot 55 of putter 16 is not tracking initial target line 30.

The indicating colors are related to the perpendicularity of putter face 22 relative to initial target line 30 and the translational alignment of putter head 20 relative to initial target line 30. To achieve the proper relationship, blade 54 is adjusted to be substantially perpendicular to putter face 22 prior to use. Accordingly, base plate 12 may include a plurality of calibration markers 56 located on body 32 (see FIGS. 2–3). For clarity, FIG. 3 only shows one calibration marker 56 on body 32. Calibration markers 56 are perpendicular to guide strip 42 and initial target line 30.

FIG. 3 shows an exemplary calibration position for putter member 14. To calibrate putter member 14, putter face 22 is aligned with one of calibration markers 56, which squares putter face 22 relative to initial target line 30. Those skilled in this art will appreciate that any convenient reference line on putter head 20 may also be aligned with calibration marker 56, as long as the reference line is parallel to putter face 22. Next, putter member 14 is adjusted on shaft 18 such that the first color (green) is displayed when blade 54 is aligned with and fully overlaps guide strip 52. Following this procedure, blade 54 should be substantially perpendicular to putter face 22 and overlapping guide strip 42, relative to the user.

To summarize, the present invention provides an improved golf stroke training device that indicates whether the club face is aligned with the initial target line, while helping the golfer visualize the directional component of the golf stroke. A device in accordance with the present invention gives the user visual feedback in real-time that is easy to interpret. In addition, the training device does not obstruct the user's view of the golf ball, nor does it interfere with the natural address position or the rolling of the golf ball. Furthermore, the present invention may be utilized on natural practice surfaces, such as a practice green.

The above description is of a preferred embodiment of the present invention, and the invention is not limited to the specific embodiment described and illustrated. For example, the specific indicating colors may be varied, and the configuration of the preferred embodiment may be altered for compatibility with different putters. In addition, although the Figures depict an embodiment suited for use with right handed putters, the present invention may also be adapted for use with left handed putters. Furthermore, many variations and modifications will be evident to those skilled in this art, and such variations and modifications are intended to be included within the spirit and scope of the invention, as expressed in the following claims.

What is claimed

1. A training apparatus for use with a golf club having a shaft and a club head attached to said shaft, said apparatus comprising:

a base plate adapted to rest on a practice surface, said base plate comprising a body, a pointer attached to said body, and means for indicating alignment of said club head relative to an initial target line for a golf ball; and a club member comprising means for mounting said club member onto said shaft, an extension arm coupled to said means for mounting, and a colored translucent blade attached to said extension arm, said club member being configured such that said means for indicating, as viewed through said blade relative to a user, appears as a first color where said blade is aligned with said means for indicating and appears as a second color where said blade is misaligned with said means for indicating.

2. An apparatus according to claim 1, wherein said means for indicating and said blade cooperate to indicate translational alignment of said club head relative to said initial target line.

3. An apparatus according to claim 1, wherein said means for indicating and said blade cooperate to indicate perpendicular alignment of said club face relative to said initial target line.

4. An apparatus according to claim 1, further comprising a calibration marker located on said body, said calibration marker being configured to facilitate perpendicular adjustment of said blade relative to a club face located on said club head.

5. An apparatus according to claim 1, further comprising a positioning marker located on said body, said positioning marker being configured to indicate an initial position of said golf ball relative to said body.

6. An apparatus according to claim 1, further comprising a tab for urging said golf ball to avoid said pointer after a practice stroke is performed.

7. An apparatus according to claim 1, wherein:

said extension arm is substantially transparent; and said club member is configured to allow a user to view said golf ball and said club head during use.

8. An apparatus according to claim 1, wherein:

said means for indicating comprises a guide strip located on said pointer and a warning background substantially surrounding said guide strip;

said first color is indicated where said blade overlaps said guide strip, relative to said user; and said second color is indicated where said blade overlaps said warning background, relative to said user.

9. An apparatus according to claim 1, wherein said base plate is configured such that said golf ball rests substantially on said practice surface before a practice stroke is performed and such that said golf ball travels over said practice surface after said practice stroke is performed.

10. A training apparatus for use with a golf club having a shaft, a club head attached to said shaft, and a club face on said club head, said apparatus comprising:

a base plate comprising means for indicating alignment of said club head relative to an initial target line; and a club member detached from said base plate and capable of free movement relative to said base plate, said club member comprising means for mounting said club member onto said shaft, an extension arm coupled to said means for mounting, and a translucent blade of a first color coupled to said extension arm, said blade having a substantially perpendicular orientation relative to said club face during use; wherein said base plate, as viewed through said blade relative to a user, appears as a second color where said blade overlaps said means for indicating.

11. An apparatus according to claim 10, wherein said means for indicating and said blade cooperate to indicate said second color when said club head is aligned with said initial target line during a practice stroke.

12. An apparatus according to claim 11, wherein:

said means for indicating comprises a guide strip located on said base plate and a warning background substantially surrounding said guide strip;

said second color is indicated where said blade overlaps said guide strip, relative to said user; and a third color is indicated where said blade overlaps said warning background, relative to said user.

13. An apparatus according to claim 12, further comprising a contact zone indicator located on said guide strip, said contact zone indicator being positioned such that it approximately indicates where said club face reaches a contact point during said practice stroke.

14. An apparatus according to claim 23, wherein:

said base plate further comprises a pointer for pointing at a target; and said means for indicating is located on said pointer.

15. An apparatus according to claim 10, wherein:

said extension arm is substantially transparent; and said club member is configured to allow said user to view a golf ball and said club head during use.

16. An apparatus according to claim 10, further comprising a calibration marker located on said base plate, said calibration marker being configured to facilitate perpendicular adjustment of said blade relative to said club face.

17. A training apparatus for use with a golf club having a club head and a club face on said club head, said apparatus comprising:

a base plate comprising a pointer for directionally adjusting said base plate relative to a target, a guide strip of a first color located on said pointer, and a warning background of a second color substantially surrounding said guide strip; and a club member detached from said base plate and configured to couple to said golf club, said club member comprising a translucent blade of a third color, said blade having a substantially perpendicular orientation relative to said club face during use; wherein said guide strip, as viewed through said blade relative to a user, appears as a fourth color where said blade overlaps said guide strip; and said warning background, as viewed through said blade relative to said user, appears as a fifth color where said blade overlaps said warning background, said fifth color contrasting with said fourth color.

* * * * *

UNITED STATES PATENT AND TRADEMARK OFFICE

CERTIFICATE OF CORRECTION

PATENT NO. : 5,551,924

DATED : 3 September 1996

INVENTOR(S) : Daniel C. Zumtobel

It is certified that error appears in the above-indentified patent and that said Letters Patent is hereby corrected as shown below:

In Column 8, Line 9, please delete "claim 23" and insert --claim 10-- therefor.

Signed and Sealed this

Nineteenth Day of November, 1996

Bruce Lehman

*Attest:*

BRUCE LEHMAN

*Attesting Officer*

*Commissioner of Patents and Trademarks*